US005293149A

United States Patent [19]

Wilson et al.

[11] Patent Number: 5,293,149

[45] Date of Patent: Mar. 8, 1994

[54] VEHICLE HORN WITH ELECTRONIC SOLID STATE ENERGIZING CIRCUIT

[75] Inventors: Carl R. Wilson, Texico; Jeffrey G. Hertenstein, Flora, both of Ill.

[73] Assignee: Sparton Corporation, Jackson, Mich.

[21] Appl. No.: 684,693

[22] Filed: Apr. 12, 1991

[51] Int. Cl.[5] ..... G08B 3/00

[52] U.S. Cl. ..... 340/384.73

[58] Field of Search ..... 340/384 E, 388, 384 R; 116/142 R; 331/173; 381/192

[56] References Cited

U.S. PATENT DOCUMENTS

| | | | |
|---|---|---|---|
| 3,872,470 | 3/1975 | Hoerz et al. | 340/384 E |
| 4,540,975 | 9/1985 | Kobayashi | 340/388 |
| 4,763,109 | 8/1988 | Smith | 340/388 |
| 5,049,853 | 9/1991 | Yoon | 340/388 |
| 5,109,212 | 4/1992 | Cortinovis et al. | 340/384 E |

*Primary Examiner*—Jeffrey Hopsass

*Attorney, Agent, or Firm*—Reising, Ethington, Barnard, Perry & Milton

[57] ABSTRACT

A vehicle horn with an electronic solid state energizing circuit is described. The horn has an electromagnet for driving a diaphragm assembly which has a resonant frequency of mechanical vibration. The energizing circuit generates a DC pulse train for energizing the coil of the electromagnet to drive the diaphragm. The circuit has an adjustment for setting the pulse repetition rate of the pulse train substantially equal to the resonant frequency. It also has an adjustment for independently setting the duty cycle of the pulse train. The circuit further includes a compensator for varying the duty cycle inversely with changes in the supply voltage. An electronic power switch is connected in series with the vehicle battery and the horn coil through an unswitched power circuit. A horn switch is connected in an on/off circuit which connects the battery to a control circuit for generating the pulse train and applies it to the electronic power switch.

13 Claims, 3 Drawing Sheets

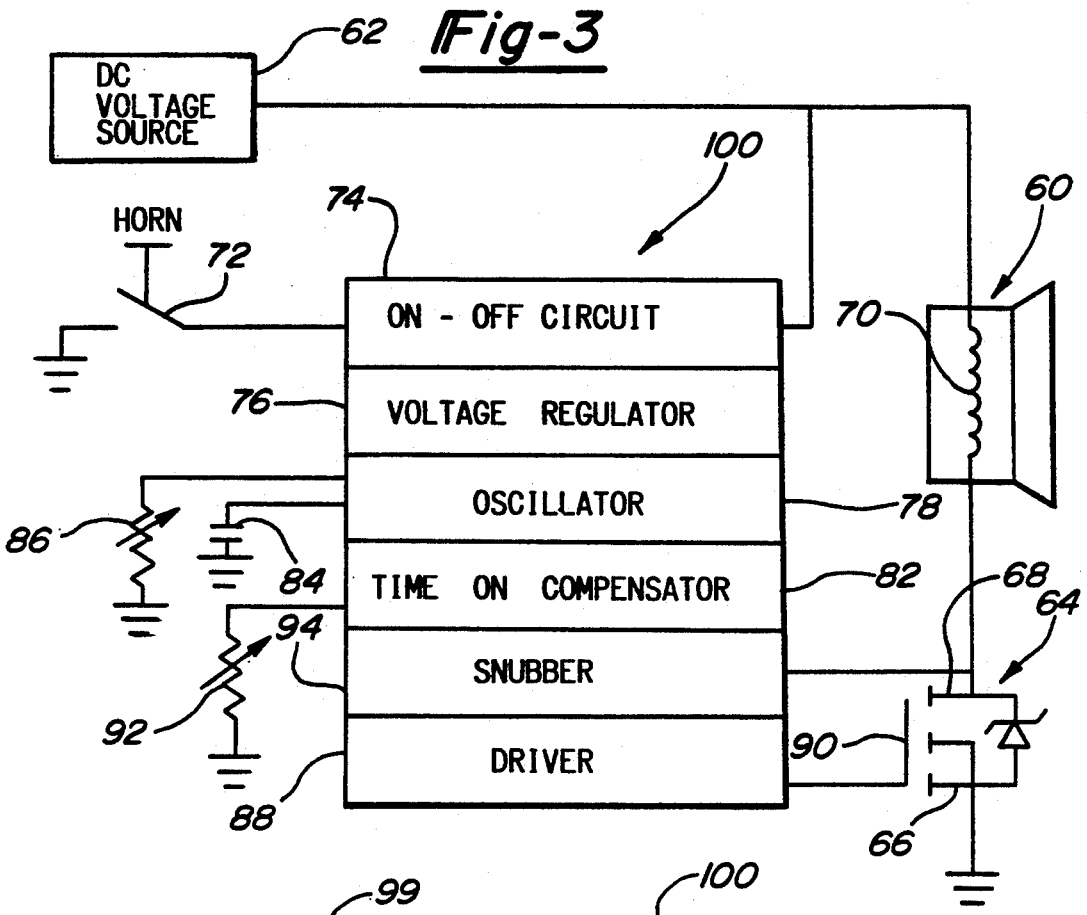
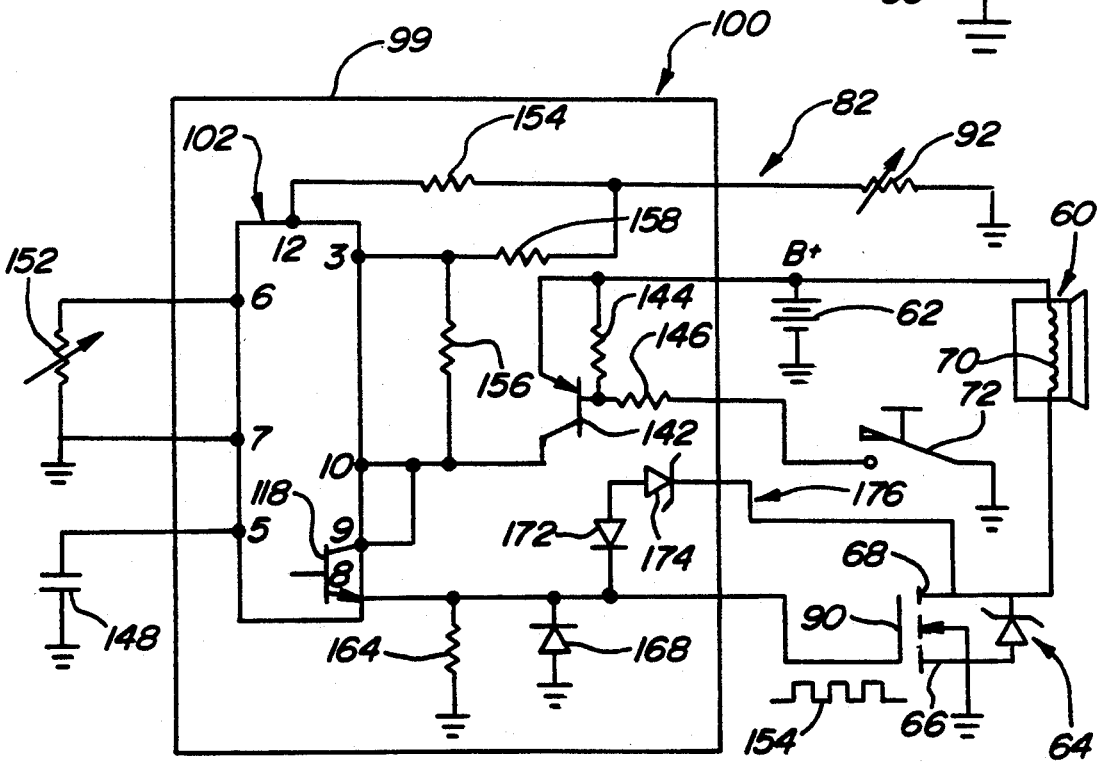
Fig-4

VEHICLE HORN WITH ELECTRONIC SOLID STATE ENERGIZING CIRCUIT

FIELD OF THE INVENTION

This invention relates to vehicle horns; more particularly, it relates to a vehicle horn having an electronic solid state energizing circuit.

BACKGROUND OF THE INVENTION

For many years, the electric horns commonly used on automotive vehicles have been of the type which generate sound by vibration of a diaphragm driven by an electromagnet motor. The horn typically comprises a housing with the diaphragm peripherally clamped thereto forming a motor chamber. The coil of the electromagnet is mounted within the chamber and a magnetic pole piece on the housing extends axially of the coil. A magnetic plunger on the diaphragm extends toward the pole piece for imparting motion to the diaphragm in response to periodic energization of the coil. The diaphragm provides a resilient suspension of the plunger for reciprocating motion relative to the coil; it has a spring characteristic whereby the diaphragm and the mass carried by it have a resonant frequency of mechanical vibration. The coil is energized from the vehicle battery through a mechanically actuated switch which is alternately opened and closed by movement of the plunger with the diaphragm. A vehicle horn of this kind is described in the Wilson et al U.S. Pat. No. 4,813,123 granted Mar. 21, 1989.

Although vehicle horns of the type just described have been eminently successful in the automotive industry for many years, there have been certain problems which, for a long time, have seemingly defied solution. One such problem is that the life of such a horn is often limited by the life of the switch contacts which are known to deteriorate over long periods of service and lead to failure of the horn. Another such problem is that of manufacturing the horn with sufficiently exacting mechanical and electrical relationships so as to obtain a high degree of operating efficiency. Particularly, such horns have not been readily adjustable to obtain operation at the maximum achievable sound pressure level for a given input power.

A vehicle horn which employs a solid state driver circuit for the horn coil is disclosed and claimed in copending patent application Ser. No. 431,696 filed Nov. 3, 1989 now U.S. Pat. No. 5,049,853 by Y. S. Yoon and assigned to the assignee of this application. In that horn, the driver circuit is adapted to energize the horn coil to cause vibrations of the diaphragm at its resonant frequency. The solid state driver has an electronic timer adjustable to the frequency of the diaphragm assembly and switches a solid state power output stage to drive the diaphragm synchronously with the timer frequency. A driver output stage comprises a power MOSFET or a Darlington pair.

The vehicle horns of the type referred to above, are typically fitted with either a resonant projector or a resonator to propagate sound pressure waves into the atmosphere. The resonant projector is a trumpet-like device comprising a spiral passageway to define an air column of increasing cross-section from the inlet end at the diaphragm to the outlet end at a bell. A horn with this acoustic coupling device is commonly known as a "seashell" horn. It generates sound by the free vibration of the diaphragm. The resonator is a vibratory plate of circular configuration which is mounted at its center on the diaphragm and plunger. In this device, the horn is energized so that the plunger strikes the pole piece during each cycle of diaphragm motion; the force of the strike is transferred to the center of the circular resonator causing it to vibrate at its natural frequency and generate sound pressure waves which are propagated directly into the surrounding atmosphere without any intermediate coupling device. This type of horn is commonly known as a "vibrator" horn. The two horns produce distinctly different sounds. A vehicle is usually provided with a pair of seashell horns or a pair of vibrator horns. To produce the desired sound one horn of each pair is designed for relatively low frequency and the other for high. For the vibrator horns this is typically three hundred fifty hertz and four hundred forty hertz. For seashell horns it is four hundred and five hundred hertz.

In such vehicle horns, it is desired to operate the horn so that the diaphragm is vibrated at its natural resonant frequency. This provides the maximum sound pressure level output from the horn for a given input power. Also, for the purpose of minimizing the power required to drive the horn, it is desired to have the air gap between the plunger and the pole piece at a minimum value consistent with the desired vibrational motion of the diaphragm. For a seashell horn, there is free vibrational motion of the diaphragm, i.e. without any physical contact of the plunger with the pole piece; on the other hand, in the vibrator horn, the vibrational motion of the diaphragm is limited, i.e. the plunger physically strikes the pole piece during each cycle of diaphragm vibration. To achieve this, the stroke length of the plunger must be correlated with the length of air gap which exists between the plunger and pole piece when the diaphragm is at rest.

In the manufacture of vehicle horns of the type having an electromagnet driven diaphragm with a plunger actuated switch contact, it has been a common practice to set the air gap between the plunger and pole piece at a determined length, within manufacturing tolerances, during fabrication of the horn. After assembly the horn is tested and, if necessary, certain adjustments are made. One of the tests, sometimes called the "buzz point" test is for the purpose of determining whether the horn will produce a desired sound quality over the full range of voltage variation likely to be encountered in vehicle operation. In this test the voltage applied to the horn is increased from a value below rated voltage to a value higher than rated voltage. The horn is checked audibly for a "buzz point" voltage, i.e. the voltage at which undesired striking of the plunger against the pole piece occurs. As noted above, no striking is desired for the seashell horn whereas striking with a moderate force is desired for the vibrator horn. An adjusting screw for the switch contacts is adjusted to increase or decrease the time duration of voltage applied to the horn coil. The horn current is also measured during the buzz point test to make sure it is within an acceptable range. If the switch contacts can be adjusted so that the buzz point does not occur when the applied voltage is below a specified value and if the current is not excessive, the horn is acceptable.

The solid state driver circuit set forth in the abovementioned patent application Ser. No. 431,696 now U.S. Pat. No. 5,049,853, constitutes a significant improvement in respect to elimination of the switch contacts and achieving horn operation with the diaphragm vibrating at its resonant frequency. It allows operation which produces the maximum sound pressure level for a given driving power applied to the horn. However, it does not lend itself to independent adjustment of driving frequency, i.e. pulse repetition rate and input power to the horn. Further, the driving frequency, and driving power varies with changes in the voltage supplied to the horn by the vehicle electrical system.

A general object of this invention is to provide a vehicle horn with a solid state energizing circuit which permits adjustment for operation with high efficiency at maximum sound pressure level and to overcome certain disadvantages of the prior art.

SUMMARY OF THE INVENTION

In accordance with this invention, a vehicle horn is provided with a solid state energization circuit which is adapted for horn operation at high efficiency of a horn with a maximum sound pressure level output.

Further, in accordance with this invention, a vehicle horn is provided with a solid state energizing circuit which generates an electronic pulse train for switching the horn coil, with adjustment means for setting the pulse repetition rate substantially equal to the resonant frequency of the diaphragm assembly and adjustment means for independently setting the duty cycle of the pulse train to a desired value.

Further, in accordance with this invention, a vehicle horn is provided with a solid state energizing circuit which is responsive to variations in the horn supply voltage for maintaining a substantially constant power input to the horn.

Further, in accordance with this invention, a vehicle horn is provided with a solid state energizing circuit which generates an electronic pulse train for switching the horn coil, the pulse repetition rate and duty cycle being independently adjustable and which includes means for varying the duty cycle inversely to variations in the supply voltage to the horn.

Further, in accordance with this invention, a vehicle horn is provided with an energization circuit which allows the use of a conventional driver operated horn switch for energizing the horn without the need for a horn relay.

A complete understanding of this invention may be obtained from the detailed description that follows taken with the accompanying drawings.

DESCRIPTION OF THE DRAWINGS

FIG. 3 is a block diagram of the electronic circuit of the electric horn of this invention;

FIG. 4 is a schematic diagram of the electronic circuit;

BEST MODE FOR CARRYING OUT THE INVENTION

Figure 1:
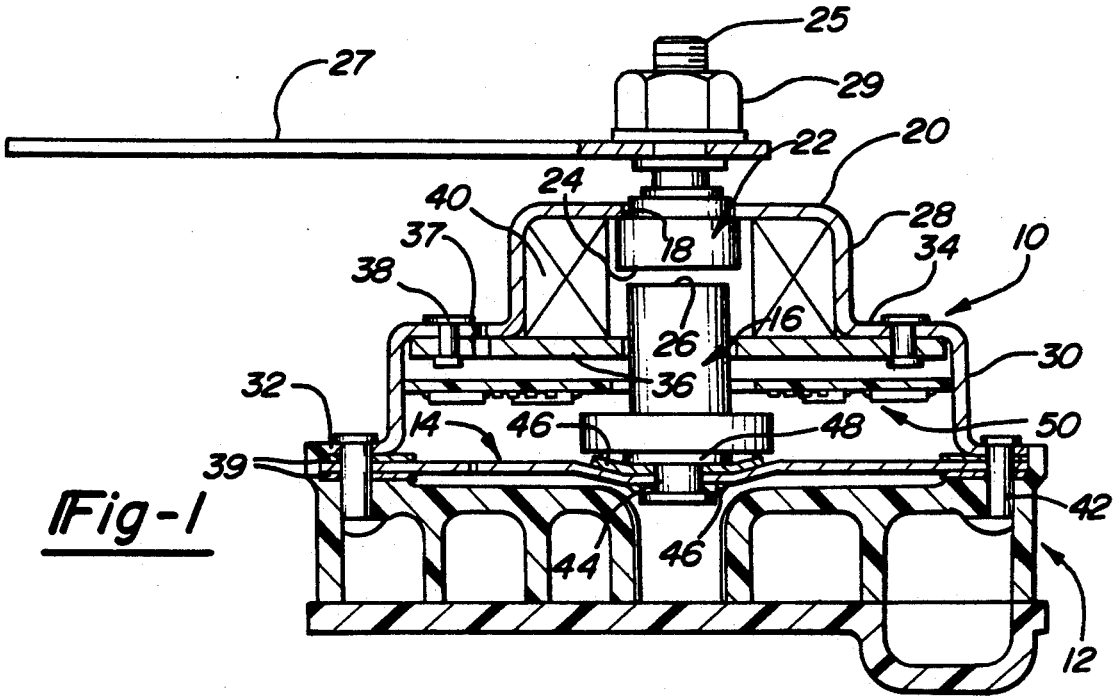
FIG. 1 is a cross-section view of an electric vehicle horn according to this invention.

Referring now to the drawings, there is shown an illustrative embodiment of the invention in electric vehicle horns of the well-known seashell and vibrator types using a particular electronic circuit which is adapted for adjustment to achieve optimal horn operation. It will be appreciated as the description proceeds, that the invention may be used in other types of horns and may be realized in different particular embodiments.

FIG. 1 shows a vehicle horn of the seashell type which incorporates the subject invention. It has a metal housing 10 secured to a plastic projector 12. A spring steel diaphragm 14 is clamped at its margin between the housing 10 and projector 12 and is attached at its center to a ferromagnetic plunger 16. An aperture 18 in an end wall 20 of the housing 10 holds a pole piece 22 which extends toward the plunger 16. An end face 24 of the pole piece 22 is spaced from an end face 26 of the plunger 16 by a small air gap. The opposite end 25 of the pole piece 22 is threaded to receive a mounting bracket 27 and a securing nut 29.

The housing 10 is stepped to define a small end portion 28 including the end wall 20, and a larger portion 30 terminating in a radial flange 32 for supporting the diaphragm. An intermediate generally planar annular portion 34 interconnects the small end portion 28 and the larger portion 30. An electromagnetic coil 40 fits within the small end portion 28 and surrounds adjacent ends of the plunger 16 and the pole piece 22. An annular mounting plate 36 secured to the intermediate portion 34 by rivets 38 retains the coil in the end portion 28. The plate 36 is apertured to accommodate the plunger 16 for free movement therein.

The diaphragm 14 is mounted on the flange 32 of the housing between annular gaskets 39 which conform to the diaphragm margin. The projector presses the gaskets 39 and diaphragm 14 against the flange 32 and fasteners 42 secure the assembly. The plunger 16 has a stem 44 of small diameter protruding through the diaphragm at its center and through a washer 46 on each side of the diaphragm. The stem defines a shoulder 48 on the plunger to engage one washer and the other washer 46, thereby securing the diaphragm and the plunger for movement as a unit. The combined mass of the diaphragm 14 and the plunger 16 along with the spring rate of the diaphragm determine the resonant frequency of the diaphragm assembly. The coil 40 is energized from the vehicle battery by the solid state energizing circuit of this invention which is provided on a circuit board 50. The circuit board can be located either inside or outside the housing. In the illustrative embodiment, the circuit board is suitably mounted on the plate 36 inside the housing and is electrically connected by external horn terminals (not shown) to the vehicle battery and to the horn switch. The housing 10 is provided with a pair of small openings 37 (one shown) which are suitably placed to permit laser trimming of resistors on the circuit board after assembly of the horn. After the resistor trimming, to be described below, the holes are filled to close the housing. The resultant sound is transmitted by the projector 12 which is tuned to the resonant frequency of the plunger/diaphragm assembly. The mechanical aspect of the horn is described in further detail in U.S. Pat. No. 4,361,952 issued to James Neese, which is incorporated herein by reference.

Figure 2:
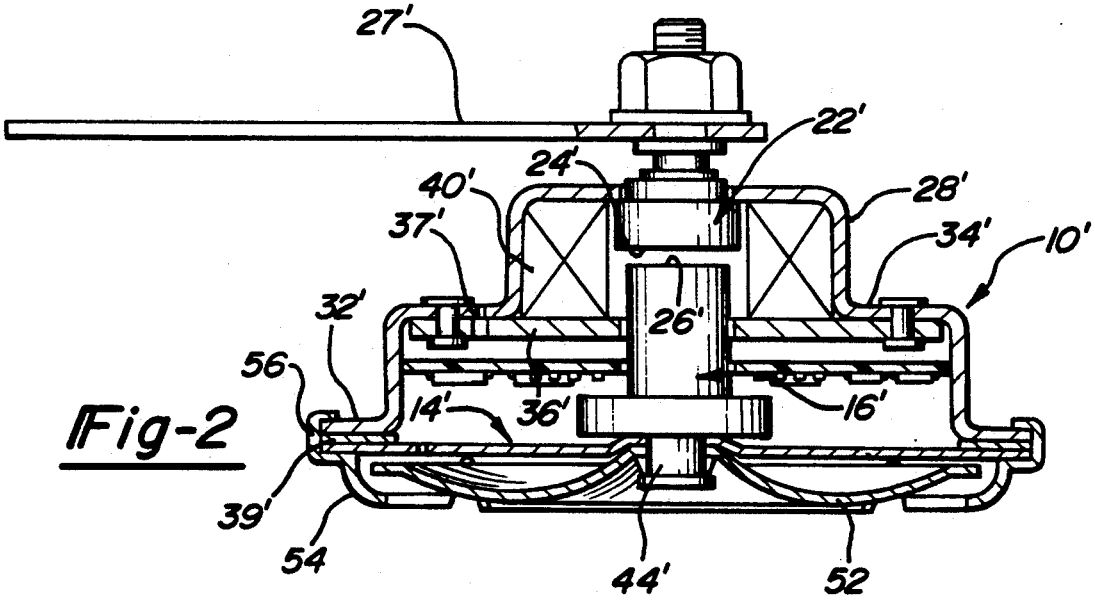
FIG. 2 is a cross-section view of another electric horn according to this invention.

FIG. 2 illustrates a vehicle horn of the vibrator type incorporating the subject invention. This horn is of the same type of construction as the seashell horn of FIG. 1 except that the plastic projector 12 of FIG. 1 is omitted and a resonator plate 52 is carried by the diaphragm 14'. The stem 44' on the plunger 16' protrudes through the center of the diaphragm 14' and resonator plate 52 and is provided with a head which secures the plate and diaphragm tightly on the plunger. An annular ring 54 has a peripheral flange 56 which clamps the periphery of the diaphragm to the flange 32' of the housing with a gasket 39' therebetween.

In this vibrator horn, the combined mass of the diaphragm 14', the plunger 16' and the resonator plate 52 along with the spring rate of the diaphragm determine the resonant frequency of the diaphragm assembly. As discussed above, this type of horn operates in such a manner that the plunger 16' physically strikes the pole piece 22' once, and once only, during each cycle of vibration of the diaphragm 14'. The force of the striking action is transmitted through the plunger 16' to the center of the resonator plate 52 and causes it to vibrate at or near its resonant frequency. The sound output from the horn is that generated by the vibration of the resonator plate 52, the sound waves being coupled directly from the resonator plate to the surrounding atmosphere.

Referring now to FIG. 3, the electronic horn energizing circuit of this invention is shown in block diagram. In general, the energizing circuit comprises a control circuit 100 and a solid state power switch in the form of a power MOSFET 64. The circuit is shown for energizing a horn 60 as it would be connected in an automotive vehicle. The horn 60 has its electromagnet coil 70 connected in series circuit with a DC voltage source 62 and the power MOSFET 64. More specifically, the power MOSFET 64 has its source 66 connected to ground and its drain 68 is connected through the coil 70 to the positive terminal of the voltage source 62, through an unswitched power circuit, the negative terminal of the voltage source being connected to ground. The horn switch 72 which is manually actuable by the vehicle driver, has its fixed contact connected directly to ground and its movable contact connected through an on/off circuit 74 to the positive terminal of the voltage source 62. When the horn switch 72 is closed, the battery voltage is applied by the on/off circuit 74 to the input of a voltage regulator 76. The voltage regulator 76 supplies a regulared supply voltage for an oscillator 78 and a time on compensator 82. The oscillator 78 is a sawtooth oscillator having an output frequency determined by a capacitor 84 and an adjustable resistor 86. The time on compensator 82 develops a control signal which is combined with the output of the oscillator 78 to generate a pulse train which is applied to the driver stage 88. The control signal produced by the time on compensator 82 determines the duty cycle of the pulse train and is adjustable by an adjustable resistor 92. The pulse train output of the driver stage 88 is applied to the gate 90 of the power MOSFET 64 which is switched on and off by the pulse train. A snubber 94 is connected from the drain to the gate of the power MOSFET to protect the circuit from transients.

The horn energizing circuit of this invention is shown in the schematic diagram of FIG. 4. In general, it comprises the control circuit 100 which controls the switching of the power MOSFET 64 for energizing the horn 60. The coil 70 of horn 60 is connected in series with the battery or B+ voltage source 62 and the power MOSFET 64. The control circuit 100 of this illustrative embodiment is implemented using certain parts of an integrated circuit chip 102 which is an MC35060 known as a SWITCHMODE (TM) pulse width modulation control circuit available from Motorola Semiconductor Products, Inc. Before proceeding with the description of the energizing circuit of FIG. 4, a brief description of the integrated circuit chip 102 will be given with reference to FIG. 5.

Figure 5:
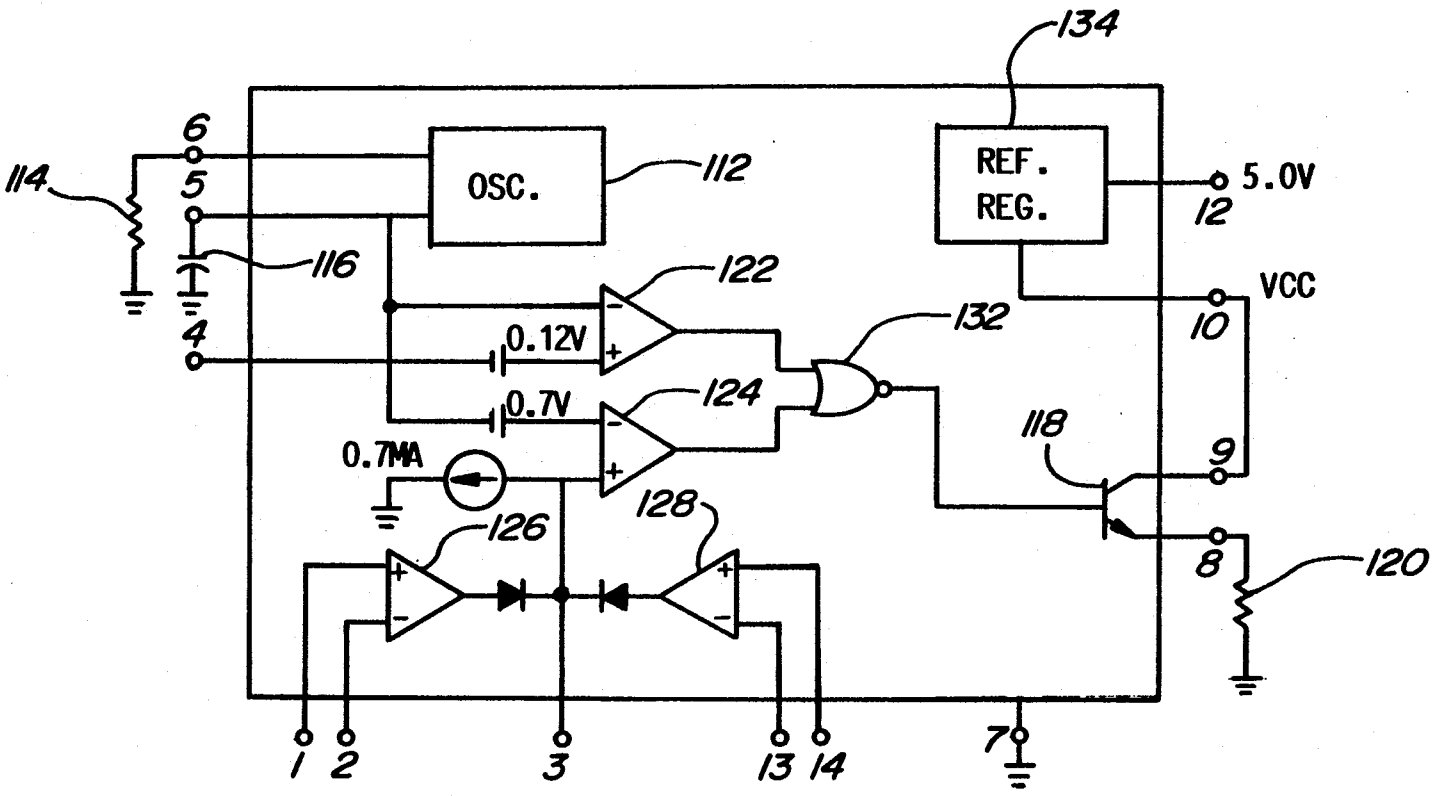
FIG. 5 is a block diagram of an integrated circuit chip useful in this invention.

FIG. 5 is a diagram of the MC35060 chip as published by the manufacturer Motorola Semiconductor Products, Inc. As described in manufacturer's bulletin, the MC35060 is a fixed frequency pulse width modulation control circuit, incorporating the primary building blocks required for the control of a switching power supply. This circuit does however include components which have been found to be convenient for implementing the control circuit of this invention. In particular, it provides a circuit which can be used as a fixed frequency pulse width modulation control circuit, as will be described. The MC35060 chip comprises a sawtooth oscillator 112 which has an oscillating frequency determined by the external resistor 114 and capacitor 116. The pulse width modulation of an output pulse train is accomplished by comparison of the positive sawtooth waveform across the capacitor 116 with either of two control signals. The output pulse train is developed at the emitter of the transistor 118 across an external resistor 120. The output at the emitter of the transistor 118 is enabled only during that portion of time when the sawtooth voltage is greater than the control signals. The control signals are external inputs that can be fed into a dead time comparator 122 or a pulse width modulation comparator 124. The control signal input to the comparator 122 is applied from pin 4 to the noninverting input and the output of the oscillator 112 is applied to the inverting input of the comparator. The dead time control comparator 122 has an effective one hundred twenty mV input offset which limits the minimum output dead time to approximately the first four percent of the sawtooth cycle time. This results in a maximum duty cycle of ninety-six percent. Additional dead time may be imposed on the output by setting the dead time control input to a fixed voltage, ranging between 0 to 3.3 volts. The pulse width modulator (PWM) comparator 124 provides a means for adjustment of the output pulse width from its maximum value down to zero, the maximum value being at ninety-six percent as set by the dead time control input. This adjustment is accomplished by a control voltage at pin 3 which is applied to the noninverting input of the PWM comparator 124 which has its inverting input connected to the output of the oscillator 112. The output pulse width is varied from its maximum value down to zero by a voltage variation at pin 3 from 0.5 to 3.5 volts. The PWM comparator 124 has an effective input offset of seven hundred mV on its inverting input. The chip also includes a pair of error amplifiers 126 and 128 which are ORed together at the noninverting input of the PWM comparator 124. An input sink current of 0.7 mA is indicated at the noninverting input of the PWM comparator 124. (The error amplifiers 126 and 128 are not used in the control circuit 100 of FIG. 4 and will not be discussed further.) The outputs of the dead time comparator 122 and the PWM comparator 124 are connected to the respective inputs of a NOR gate 132 and the output thereof is applied to the base of the transistor 118. The chip also has a voltage regulator 134 With a supply voltage input at pin 10 rated for a maximum of forty-two volts. It provides a regulated output at pin 12 of five volts. As indicated in the schematic of FIG. 4, the MC35060 IC chip is used with the connection of only pins 3, 5, 6, 7, 8, 9, 10 and 12. Thus, no input is provided to the error amplifiers 126 and 128 and accordingly these components do not affect the operation of the circuit. Also, no input is provided on pin 4 and accordingly only the offset voltage is present at the noninverting input of the dead time comparator 122. With this arrangement, the duty cycle of the square wave pulse train output at the emitter of transistor 118 can be varied from the maximum percent on-time of ninety-six percent, as established by the dead time control comparator 122, down to zero percent by variation of the input control voltage at pin 3 from 0.5 to 3.5 volts.

Referring again to FIG. 4, the detailed description of the control circuit 100 will be completed, it being understood that the integrated circuit chip 102 is an MC35060 with the pin connections indicated (and described above) or the equivalent thereof. In the manufacture of the control circuit 100, especially for high volume production, the circuit is preferably embodied in a custom integrated circuit chip having the components enclosed in the interrupted line rectangle 99 formed on the chip. Those outside the rectangle 99 are preferably external of the chip.

The control circuit 100, according to this invention, is adapted to generate a square wave pulse train and includes means for adjusting the frequency or pulse repetition rate of the pulse train; it also includes separate means for independently adjusting the duty cycle or on-time of the pulse train; further, the circuit automatically adjusts the duty cycle in response to variations of the supply voltage whereby a substantially constant power is applied to the horn despite the voltage variations. As shown in FIG. 4, the supply voltage B+ from the vehicle battery (or variable DC source for horn testing and adjustment) is connected through the coil 70 of the horn 60 to the drain 68 of the power MOSFET 64, the source 66 thereof being connected to ground and thence returned to the other terminal of the B+ supply. Thus, the power circuit for the horn is unswitched except for the power MOSFET. No horn relay is required because the horn switch 72 can directly switch the low current needed by the on/off switching circuit to be described. The on/off switching circuit includes, in general, the manually actuated horn switch 72 and a PNP switching transistor 142. The emitter of the transistor 142 is connected directly with the positive terminal of the B+ voltage source and the collector is connected directly to the input pin 10 of the integrated circuit 102. A resistor 144 is connected between the emitter and base electrodes of the transistor and the base is connected through a resistor 146 and the horn switch 72 to ground. When the horn switch 72 is closed, the transistor 142 is turned on and the positive terminal of the B+ voltage source is connected by the transistor to the input pin 10 of the integrated circuit 102. The pin 7 of the circuit 102 is connected directly to ground. The sawtooth oscillator 112 of the integrated circuit 102 (see FIGS. 4 and 5) and the other circuits of the integrated circuit 102 become operative when the B+ voltage is applied to pin 10. The sawtooth oscillator 112 operates at a frequency determined by the value of the fixed capacitor 148 connected from pin 5 to ground and the value of the adjustable trimmer resistor 152 connected between pin 6 and ground. The value of resistor 152 determines the frequency of the square wave pulse train 154 produced at pin 8 (emitter of transistor 118) of the integrated circuit 102.

The duty cycle of the pulse train 154 is established by the control voltage which is applied to pin 3 of the integrated circuit 102. This control voltage is developed by the duty cycle or time on compensator circuit 82 as follows. The compensator circuit 82 comprises a fixed resistor 154 and the adjustable trimmer resistor 92 connected in series between the pin 12 of circuit 102 and ground. The pin 12 supplies a regulated voltage or reference voltage across the resistors 154 and 92 in a voltage divider arrangement. The compensator circuit 82 also comprises fixed resistors 156 and 158 connected in series with the trimmer resistor 92 between the pin 10 of circuit 102 and ground in a voltage divider arrangement across the B+ voltage source. The voltage developed at the junction of resistors 156 and 158 constitutes a control voltage which is applied to pin 3 of the circuit 102 to establish the duty cycle of the pulse train 154. It is noted that the control voltage at the pin 3 is subject to variation by adjustment of variable resistor 92 and by changes of the B+ voltage. With this arrangement, it is observed that if the B+ voltage is held at a constant value, the control voltage at pin 3 will be held at a constant value determined by the adjusted setting of the resistor 92. Thus, the duty cycle of the pulse train 154 would be held at a corresponding constant value. If, on the other hand, the B+ voltage varies, with the variable resistor 92 at a fixed value, the control voltage at pin 3 will vary; in particular, a decrease in the B+ voltage will result in a decrease in the control voltage at pin 3 and the duty cycle will be increased and vice versa. Since the B+ voltage source is used for energizing the horn through the power MOSFET 64 and also is applied to the compensator circuit 82, the circuit 82 responds to variations in the value of B+ voltage in such manner as to tend to maintain a constant power of energization of the horn despite variations in the B+ voltage. The rate of change of duty cycle for an increment of change of B+ voltage is determined to a large extent by the ratio of the resistance of resistor 158 to the resistance of resistor 154.

The control circuit 100 utilizes the NPN transistor 118 as the driver 88 which supplies the pulse train 154 to the gate 90 of the power MOSFET 64. A resistor 164 is connected between pin 8 and ground to avoid retention of charge at the gate between input pulses. Also a diode 168 is connected between pin 8 and ground to clip any negative spikes at the gate. In order to protect the MOSFET against transient voltages, a snubber circuit 176 is employed. The circuit includes a diode 172 and zener diode 174 connected with their anodes back-to-back between the pin 8 and the drain of power MOSFET 64. The flyback voltage from the coil 70 causes the zener diode to break down and the MOSFET is gated on to drain the flyback current to ground. The diode 172 blocks current in the forward direction of the zener.

According to this invention, the frequency and the duty cycle of the horn are adjusted as a part of the manufacturing process as follows. The horn 60, either a seashell horn or a vibrator horn such as in FIGS. 1 or 2, is adjusted and suitably tested after the horn is assembled. When the horn is assembled, the air gap between the plunger and the pole piece is established at a determined value within manufacturing tolerance. With the rated B+ voltage applied to the horn, suitably from adjustable DC source, the frequency, i.e. pulse repetition rate, of the pulse train generated by the control circuit is set to the resonant frequency of the diaphragm assembly of the horn by adjustment of the trimmer resistor 152. The adjustment is preferably done by laser trimming, although it could be done by hand. The desired setting, for this purpose, of the variable resistor 152 is achieved when the horn produces the maximum sound pressure level as indicated by a standard db meter, at a predetermined distance from the horn. With the energizing circuit adjusted to operate at the resonant frequency of the diaphragm assembly, the duty cycle of the pulse train 154 is adjusted to obtain the desired horn operation. For this purpose, the B+ voltage is set at a test value for the horn and the duty cycle is adjusted upwardly from a relatively low value by decreasing of the variable resistor 92. The duty cycle is thus increased until the quality of the sound produced by the horn becomes undesirable. As described above, in the case of the seashell horn, this undesirable sound quality occurs when the buzz point of the horn is reached, i.e. when the plunger strikes the pole piece. Then, the duty cycle is decreased to avoid the physical contact, typically by about two percent reduction in duty cycle. In the case of the vibrator horn, the same procedure applies except that normal operation requires striking of the plunger against the pole piece and, duty cycle is increased to produce such striking; however, when the striking becomes too forceful and an undesired sound quality is produced, the duty cycle is decreased by a small amount to obtain the desired sound quality. During this adjustment of duty cycle, the RMS value of current drawn by the horn is monitored to ensure that it is within a rated values. If the current does not fall within this range, the mechanics of the horn, such as the air gap, may need to be adjusted before a satisfactory performance can be obtained. With the horn adjusted for operating frequency and duty cycle it is ready for installation in a vehicle. The frequency will remain constant and the duty cycle will vary in accordance with B+ voltage variation under the control of the compensator circuit 82 to maintain substantially constant power energization of the horn.

Although the description of this invention has been given with reference to a particular embodiment, it is not to be construed in a limiting sense. Many variations and modifications will now occur to those skilled in the art. For a definition of the invention reference is made to the appended claims.

What is claimed is:

1. A horn for an automotive vehicle having a vehicle supply voltage source, said horn comprising:

a housing having a diaphragm mounted on the housing with its periphery clamped thereto and forming a chamber, a driving coil mounted within said chamber, a magnetic pole piece mounted on said housing and extending axially of said coil, a magnetic plunger mounted on said diaphragm and extending toward said pole piece for imparting motion to the diaphragm upon energization of said coil, said diaphragm providing a resilient suspension of said plunger for reciprocating motion relative to said coil and having a spring characteristic whereby said diaphragm and the mass carried thereby have a resonate frequency of mechanical vibration, an energizing circuit coupled between said voltage source and said coil for generating a DC pulse train for energizing said coil, said energizing circuit including first adjustment means for setting the pulse repetition rate of said pulse train substantially equal to said resonant frequency, and said energizing circuit including a second adjustment means for setting the duty cycle of each pulse in said pulse train to a desired value.

2. The invention as defined in claim 1 wherein:

said second adjusting means is independent of said first adjusting means.

3. The invention as defined in claim 1 wherein:

said energizing circuit includes means for varying said duty cycle inversely with changes in the voltage of said supply voltage source.

4. The invention as defined in claim 1 wherein said energizing circuit comprises:

a control circuit for generating said pulse train, an electronic power switch connected in series with said voltage source and said driving coil, the output of said control circuit being coupled with the input of said power switch whereby said power switch is turned on during each pulse of said pulse train.

5. The invention as defined in claim 4 wherein said control circuit includes:

an on/off circuit including a manually actuable horn switch for connecting said supply voltage source with said control circuit for generating said pulse train, and a driver circuit coupled with the input of said power switch for supplying said pulse train to said power switch when said horn switch is actuated.

6. The invention as defined in claim 1 wherein said energizing circuit includes:

an adjustable frequency oscillator, control signal generating means, said oscillator frequency being adjustable by said first adjustment means, said control signal being adjustable in amplitude by said second adjustment means, and means for enabling the output of each pulse in said pulse train only during the time that the oscillator output voltage is greater than said control signal voltage whereby the duty cycle of the pulse train is adjustable.

7. The invention as defined in claim 4 wherein said control circuit includes:

a comparator, an adjustable frequency oscillator having its output coupled to one input of said comparator, control signal generating means having its output coupled with the other input of said comparator, said oscillator frequency being adjustable by said first adjustment means, said control signal being adjustable in amplitude by said second adjustment means, whereby said comparator produces an output pulse for said pulse train only during the time that the oscillator output voltage is greater than said control signal voltage.

8. The invention as defined in claim 7 wherein said oscillator is a sawtooth voltage oscillator.

9. A method of adjusting the sound produced by a vehicle horn for an automotive vehicle, said horn comprising a housing having a diaphragm mounted thereon with its periphery clamped thereto and forming a chamber, a driving coil mounted within the chamber, a magnetic pole piece mounted on said housing and extending axially of said coil, a magnetic plunger mounted on said diaphragm and extending toward said pole piece for imparting motion to the diaphragm upon energization of said coil, an air gap between the opposed faces of the magnetic pole piece and the plunger, the diaphragm providing a resilient suspension of the plunger for reciprocating motion relative to the coil and having a spring characteristic whereby the diaphragm and the mass carried thereby have a resonant frequency of mechanical vibration, an electronic power switch coupled between said voltage source and the coil for energizing the coil, and a control circuit for generating a DC pulse train for switching the power switch on and off, said method comprising the steps of:

adjusting the pulse repetition rate of said pulse train to a value substantially equal to said resonant frequency, and adjusting the duty cycle of each pulse in said pulse train to a desired value without changing the pulse repetition rate of the pulse train.

10. The invention as defined in claim 9 wherein said method includes the step of:

adjusting said duty cycle to a value that will vibrate said diaphragm without causing said plunger to contact said pole piece.

11. The invention as defined in claim 9 wherein said method comprises the step of:

adjusting said duty cycle to a value which causes said plunger to contact said pole piece once for each pulse of said pulse train.

12. The invention as defined in claim 9 wherein said method includes the step of:

adjusting said pulse repetition rate of said pulse train to a value which produces a maximum value of sound pressure level output from said horn.

13. The invention as defined in claim 4 wherein, said electronic power switch is a power MOSFET, a snubber circuit connected between the drain and gate of said power MOSFET, said snubber circuit comprising a zener diode and a blocking diode connected in series with the anodes thereof connected together.

* * * * *